US009499915B2

(12) United States Patent
Al-Mahrous et al.

(10) Patent No.: US 9,499,915 B2
(45) Date of Patent: Nov. 22, 2016

(54) ENCAPSULATED IMPRESSED CURRENT ANODE FOR VESSEL INTERNAL CATHODIC PROTECTION

(71) Applicant: Saudi Arabian Oil Company, Dhahran (SA)

(72) Inventors: Husain M. Al-Mahrous, Dhahran (SA); Mansour A. Al-Shafei, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 14/199,780

(22) Filed: Mar. 6, 2014

(65) Prior Publication Data

US 2014/0262825 A1 Sep. 18, 2014

Related U.S. Application Data

(60) Provisional application No. 61/790,475, filed on Mar. 15, 2013.

(51) Int. Cl.

| | |
|---|---|
| ***C23F 13/00*** | (2006.01) |
| ***C23F 13/10*** | (2006.01) |
| ***C23F 13/06*** | (2006.01) |
| ***C23F 13/16*** | (2006.01) |

(52) U.S. Cl.
CPC ..... *C23F 13/10* (2013.01); *C23F 13/06* (2013.01); *C23F 13/16* (2013.01)

(58) Field of Classification Search
CPC ..... C23F 13/02; C23F 13/06; C23F 13/08; C23F 13/10; C23F 13/12; C23F 13/16; C23F 13/18; C23F 2213/22; C23F 2213/30–2213/32; C23F 2213/20
USPC ..... 204/196.01, 196.3, 196.37
See application file for complete search history.

(56) References Cited

U.S. PATENT DOCUMENTS

| | | | |
|---|---|---|---|
| 2,818,079 | A | 12/1957 | Garrison |
| 3,978,309 | A | 8/1976 | Strobach et al. |
| 4,017,714 | A | 4/1977 | Kreiser |
| 4,060,472 | A | 11/1977 | Alewitz |
| 4,093,529 | A | 6/1978 | Strobach |

(Continued)

FOREIGN PATENT DOCUMENTS

GB 851884 A 10/1960

OTHER PUBLICATIONS

Bushman (Impressed Current Cathodic Protection System Design, Bushman & Associates, Inc, 2008, pp. 1-17, http://www.bushman.cc/pdf/impressed_current_system_design.pdf).*

(Continued)

*Primary Examiner* — Luan Van
*Assistant Examiner* — Alexander W Keeling
(74) *Attorney, Agent, or Firm* — Bracewell LLP; Constance G. Rhebergen; Vivek P. Shankam

(57) ABSTRACT

Embodiments of a system and method for providing cathodic protection to a vessel include encapsulating a dimensionally stable anode with a wax-repellant cementitious coating. The anode, with the encapsulant, is inserted into a structure to be protected, such as a vessel for handling wet crude. A power supply is connected to the anode and to the vessel, making the vessel a cathode. When power is applied, ions flow from the anode, through the encapsulant and fluids in the vessel, to the vessel structure. The encapsulant prevents paraffin wax from building up on the anode.

21 Claims, 3 Drawing Sheets

(56) References Cited

U.S. PATENT DOCUMENTS

| | | | | |
|---|---|---|---|---|
| 4,136,001 | A | 1/1979 | Nozaki | |
| 4,170,532 | A | 10/1979 | Tatum | |
| 4,231,852 | A | 11/1980 | Ruckert | |
| 4,306,189 | A | 12/1981 | Nozaki | |
| 4,397,726 | A * | 8/1983 | Schwert | 204/196.18 |
| 4,486,288 | A | 12/1984 | Linder | |
| 4,614,574 | A | 9/1986 | Bussell | |
| 4,773,977 | A | 9/1988 | Houle et al. | |
| 4,830,724 | A | 5/1989 | Houle | |
| 4,910,865 | A | 3/1990 | Houle | |
| 4,946,570 | A * | 8/1990 | Kumar | 204/196.3 |
| 4,954,172 | A | 9/1990 | Houle et al. | |
| 4,954,233 | A | 9/1990 | Houle et al. | |
| 4,972,066 | A | 11/1990 | Houle et al. | |
| 5,023,928 | A | 6/1991 | Houle et al. | |
| 5,176,807 | A | 1/1993 | Kumar | |
| 5,183,694 | A * | 2/1993 | Webb | 205/734 |
| 5,256,267 | A | 10/1993 | Roden | |
| 5,316,641 | A * | 5/1994 | Wright et al. | 204/196.15 |
| 5,334,299 | A | 8/1994 | Roden | |
| 5,411,646 | A | 5/1995 | Gossett et al. | |
| 5,505,826 | A | 4/1996 | Haglin et al. | |
| 5,609,748 | A | 3/1997 | Kotowski et al. | |
| 6,346,188 | B1 | 2/2002 | Shuster et al. | |
| 6,606,452 | B1 | 8/2003 | Caine | |
| 6,903,540 | B2 | 6/2005 | Kean et al. | |
| 7,017,251 | B1 | 3/2006 | Murphy | |
| 7,372,005 | B2 | 5/2008 | Knoeppel et al. | |
| 7,387,713 | B2 | 6/2008 | Marcelino et al. | |
| 7,499,525 | B2 | 3/2009 | Horndler et al. | |
| 7,507,319 | B2 | 3/2009 | Kuriyama et al. | |
| 7,527,714 | B2 | 5/2009 | Kahite et al. | |
| 7,578,910 | B2 | 8/2009 | Sirola et al. | |
| 7,857,949 | B2 | 12/2010 | Closset et al. | |
| 7,857,950 | B1 | 12/2010 | North | |
| 8,157,983 | B2 | 4/2012 | Bennett | |
| 2007/0187854 | A1 | 8/2007 | Sirola et al. | |
| 2009/0183998 | A1 * | 7/2009 | Bennett | 205/734 |
| 2010/0044218 | A1 * | 2/2010 | Funahashi | 204/280 |
| 2011/0168571 | A1 | 7/2011 | Glass et al. | |
| 2012/0261270 | A1 | 10/2012 | Glass et al. | |
| 2013/0013228 | A1 * | 1/2013 | Genta | G01M 3/18 702/51 |

OTHER PUBLICATIONS

Jesco (General Data: Chemical Resistance Chart, pp. 1-8, 2011, http://www.lutzjescoamerica.com/fileadmin/data/data_usa/documents/Chemical_Resistance_Chart.pdf).*

PCT International Search Report and the Written Opinion of the International Searching Authority dated Jul. 23, 2014; International Application No. PCT/US2014/023929; International File Date: Mar. 12, 2014.

* cited by examiner

ENCAPSULATED IMPRESSED CURRENT ANODE FOR VESSEL INTERNAL CATHODIC PROTECTION

CROSS REFERENCE TO RELATED APPLICATION

This application claims priority to and the benefit of U.S. Provisional Application Ser. No. 61/790,475, filed Mar. 15, 2013 the full disclosure of which is hereby incorporated by reference herein for all purposes.

BACKGROUND OF THE INVENTION

Field of the Invention

Embodiments of the present invention relate in general to cathodic protection and specifically to internal cathodic protection of a fluid-containing vessel.

Description of the Related Art

Corrosion protection is required for steel structures that are exposed to corrosive fluids. The steel structures can be any structure exposed to corrosive fluids including, for example, a vessel that contains or is exposed to water or corrosive fluids. A protective coating on the steel or cathodic protection can be used to protect steel from corroding.

Cathodic protection for vessels is typically done with galvanic anodes in a technique known as galvanic anode corrosion protection ("GACP"). There are three types of galvanic anodes that are typically used for corrosion protection, namely, magnesium, aluminum and zinc anodes. The magnesium anodes often demonstrate high potential and, thus, corrode in less than one year in vessel protection. The aluminum anodes are also consumed rapidly, particularly when the temperature is more than 50° C. in the vessel. The normal zinc anodes are not consumed as quickly, but may reverse polarity at higher temperatures, meaning instead of acting as anodes, they may become the cathode at high temperature. That is why high temperature zinc ("HTZ") anodes are often used in vessels at temperatures above 50° C. and up to 70° C. These GACP conventional anodes demonstrate undesirable properties when used in severe conditions. What is meant by severe here is a combination of low resistivity, high temperature and/or high $H_2S$. The consumption rate of HTZ anodes, for example, is increased from 12 Kg/A-Y in normal conditions to 16 Kg/A-Y in severe conditions. That is 30% more, reflecting into 30% shorter anode life.

Another problematic issue in traditional cathodic protection systems is known as erosion corrosion. Where fluids are flowing past an exposed anode, the anode can deteriorate due to erosion from such flowing fluid.

SUMMARY OF THE INVENTION

Embodiments of an apparatus and method for protecting vessels from corrosion is disclosed. In embodiments, a dimensionally stable impressed current precious anode, such as Mixed Metal Oxide ("MMO"), platinized niobium ("PtNb") and platinized titanium ("PtTi") anode is encapsulated in a wax-repellent layer and then installed inside wet crude handling facilities such as, for example, High Pressure Production Traps ("HPPT"), Low Pressure Production Traps ("LPPT), Water and Oil Separation Plants ("WOSEP"), Desalters and/or Dehydrators.

Precious anodes such as MMO, PtNb or PtTi have been tested in real conditions but failed when a layer of paraffin wax developed on their surfaces, which prevented them from further corrosion. Embodiments of the present invention use a dimensionally stable impressed current anode encapsulated in a wax-repellent layer. In embodiments, one or more conductive, cementitious layers are used to coat each CP anode. When cement was used around conventional anodes (galvanic or impressed current), the cement layer tends to crack as the anode corrodes away. In embodiments, dimensionally stable anodes are used. Dimensionally stable means that the consumption (corrosion/dissolution) rate is so small that the anodes do not change in size or the change in size is so negligible.

Embodiments of a cathodic protection system include a vessel for containing a fluid; an anode positioned inside the vessel; an encapsulant encapsulating the anode, the encapsulant being a wax repellant material that is sufficiently porous to allow ions to pass therethrough; and an impressed current source electrically connected to each of the anode and the vessel, the vessel being a cathode when current is applied from the current source. In embodiments, the encapsulant comprises cement and carbon. In embodiments, the encapsulant has pores and the pores can have a diameter in the range of 100 μm to 650 μm. In embodiments, the encapsulant can be acid resistant and, more specifically, can be resistant to $H_2S$. In embodiments, the vessel can be a wet crude handling vessel.

In embodiments, the encapsulant is spaced apart from the vessel. The encapsulant can be hydrophilic, can be fluid permeable, and can be cementitious. In embodiments, a dimension of an exterior surface of the anode does not change in response to corrosion. In embodiments, the anode material can include MMO, PtNb or PtTi.

Embodiments of a cathodic protection system include a vessel having an interior surface; a first phase fluid and a second phase fluid contained within the vessel; a plurality of anodes connected to the interior surface of the vessel, the plurality of anodes being spaced apart from each other and at least a portion of the anodes being positioned within the second phase fluid; an impressed current source electrically connected to the anode; and an encapsulant encapsulating the anode, the encapsulant being a wax repellant material and being operable to transmit ions through the second fluid from the anode to the cathode. In embodiments, the first phase comprises crude oil and the second phase comprises water.

Embodiments of a method of providing corrosion protection to a vessel include the steps of selecting an anode size to provide a predetermined amount of cathodic protection at a predetermined voltage, based on the fluids and conditions expected in the vessel, the size of the vessel, and the number of anodes to be used; selecting a minimum thickness for an encapsulant to encapsulate the anode; determining a minimum size of a container to be used, the minimum size having an internal dimension greater than a dimension of the anode and the thickness of the encapsulant; inserting the anode into the container and filling the remaining space in the container with the encapsulant, the encapsulant being in a generally liquid, uncured state; curing the encapsulant to a hardened state and then removing the anode and the encapsulant from the container; connecting the anode to a mount and then connecting the mount to the vessel so that the anode is positioned inside the vessel; and filling the vessel with fluid and applying a voltage between the vessel and the anode so that ions flow from the anode, through the fluid, to the vessel.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to embodiments thereof which are illustrated in the attached drawings, which drawings form a part of this specification. It is to be noted, however, that the drawings illustrate only a preferred embodiment of the invention and therefore should not be considered limiting of its scope as the invention may admit to other equally effective embodiments.

DETAILED DESCRIPTION OF THE INVENTION

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Cathodic protection ("CP") systems are used to protect steel components from corrosion. One particular type of CP system is known as a galvanic anode cathodic protection ("GACP") system. In GACP systems, steel structures can be protected from corrosion ("a protected metal") by being positioned as a cathode in an electrochemical cell that includes an anode composed of a more highly reactive metal than the cathode. The anodes can be composed of, for example, highly reactive metals such as aluminum, zinc, or magnesium. The electrochemical cell includes an electrolyte (e.g., water or moist soil), and the anode and the cathode are positioned in the same electrolyte to provide an ion pathway between the anode and the cathode. In the electrochemical cell, the anode and the cathode are also electrically connected to provide an electron pathway between the anode and the cathode.

When the protected metal and the anode are positioned in the electrochemical cell accordingly, the more reactive anode corrodes in preference to the protected metal structure, thereby preventing corrosion of the protected metal. Due to the difference in the natural potentials between the anode and the protected metal, by their relative positions in the electrochemical cell, when the anode corrodes, high-energy electrons flow from the anode to the cathode through the electrical connection, thereby preventing an oxidation reaction at the protected metal structure. Thus, the anode corrodes instead of the protected metal (the cathode), until the anode material is depleted. The anode in a GACP system is known as a "sacrificial anode," and likewise, GACP systems are also known as "sacrificial anode systems."

Figure 1:
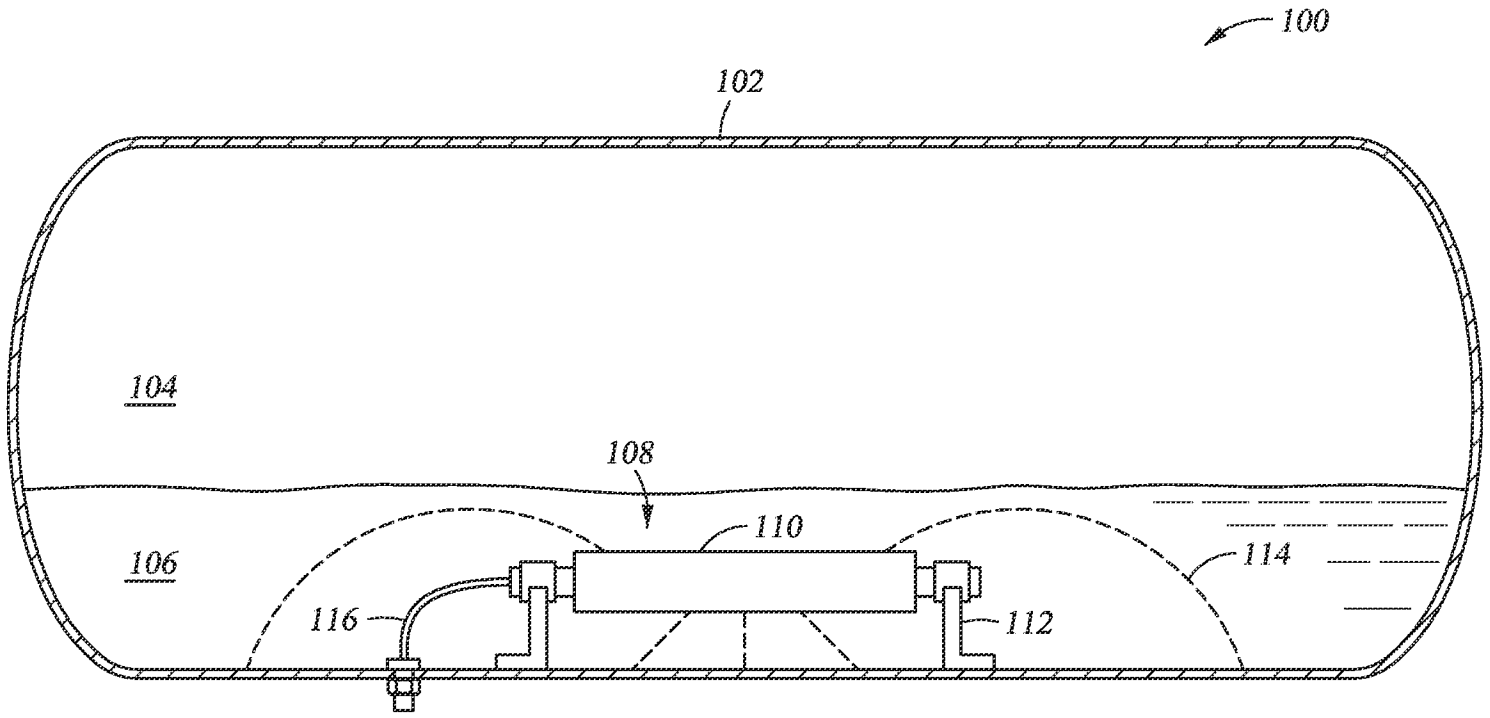
FIG. 1 is a partial side sectional environmental view of an embodiment of a galvanic anode cathode protection system according to an embodiment of the invention.

A galvanic cathodic protection system 100 is shown in FIG. 1. System 100 includes a vessel 102, which is a vessel for containing fluids or that is otherwise in contact with fluids. In this embodiment, vessel 102 is the protected metal. Vessel 102 can be any type of vessel including, for example, a storage tank, a settling tank, or process equipment used to process fluids. As shown in FIG. 1, vessel 102 is a storage vessel for storing or separating a fluid such as wet crude. As one of skill in the art will appreciate, wet crude is crude oil having droplets of water suspended therein. Over time, the fluids separate to form a first phase 104 and a second phase 106. In the embodiment shown, the first phase 104 is predominantly crude oil, and the second phase 106 is predominantly water. Corrosion is most likely to occur in water phase 106.

Anode assembly 108 is a galvanic anode assembly for providing corrosion protection to vessel 102. One or more anode assemblies 108 are spaced apart around the interior surfaces of vessel 102. A large storage vessel, for example, can have 50 anode assemblies 108, although more or fewer anode assemblies 108 can be used. Anode assembly 108 includes anode 110 mounted on and electrically connected to anode mount 112. Anode mount 112 is mechanically and/or electrically connected to the interior surface of vessel 102 so that electric current can flow between anode mount 112 and vessel 102. As one of skill in the art will appreciate, anode 110 has more negative electrochemical potential than vessel 102, so that electric current flows from vessel 102 to anode 110. Ions 114 flow from anode 110 to vessel 102. The anode provides corrosion protection to vessel 102. In embodiments, test cable 116 is electrically connected to anode 110 and can be used to monitor the condition of anode 110 and determine, for example, if the anode 110 is failing.

Another type of CP system is known as an impressed-current cathodic protection ("ICCP") system. ICCP systems use anode metals connected to an external power source to provide greater current output. Impressed-current cathodic protection systems employ D/C power (e.g., rectified A/C power) to impress a current between one or more anodes and the cathode.

Figure 2:
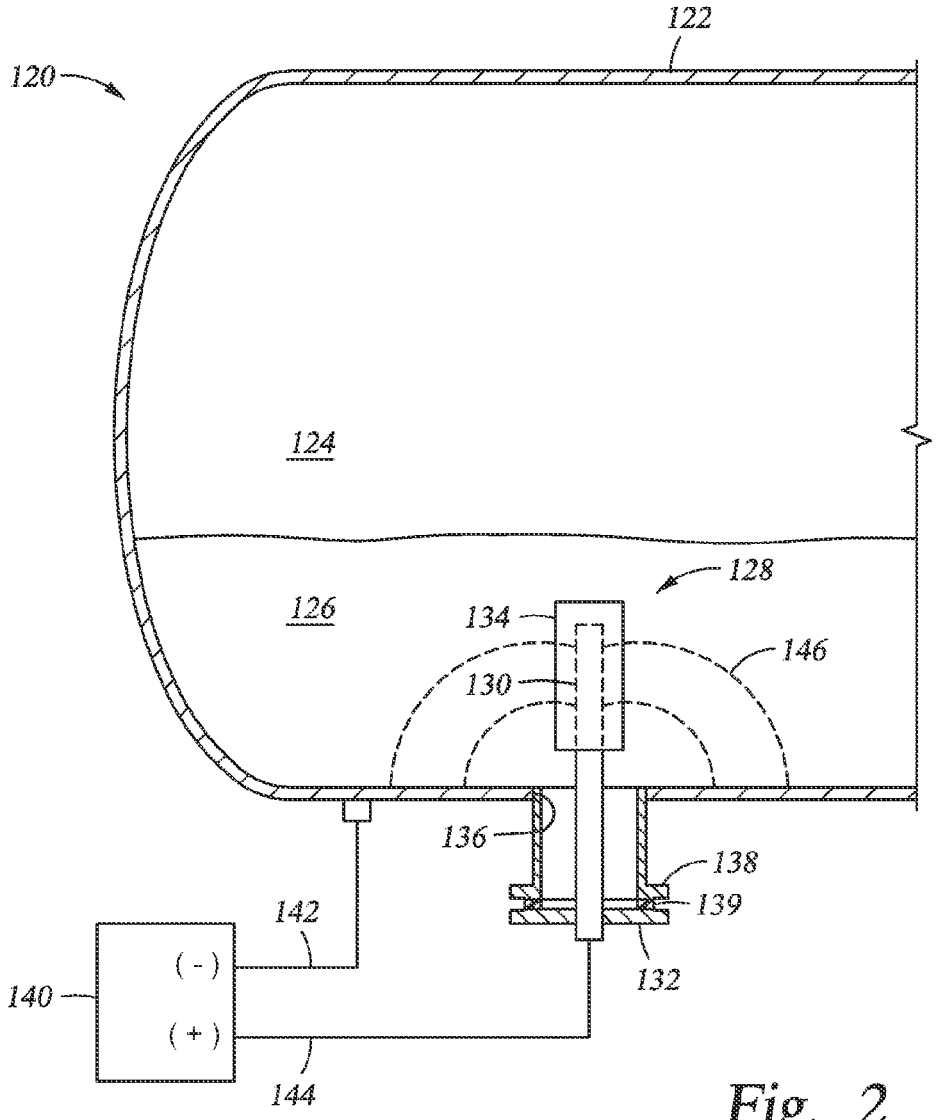
FIG. 2 is a partial side sectional environmental view of an embodiment of an impressed current cathode protection system according to another embodiment of the invention.

An impressed current cathodic protection system 120 is shown in FIG. 2. System 120 includes a protected metal structure to be protected from corrosion, such as vessel 122. Vessel 122 can be a vessel for storing or processing fluids, including, for example, a storage tank, a settling tank, or process equipment used to process fluids. In embodiments, vessel 122 can be, for example, a high pressure production trap, a low pressure production trap, a water and oil separation plant, a desalter, or a dehydrator. In the embodiment shown in FIG. 2, vessel 122 is a storage vessel for storing or separating a fluid such as wet crude. As one of skill in the art will appreciate, wet crude is crude oil having droplets of water suspended therein. Over time, the fluids separate to form a first phase 124 and a second phase 126. In the embodiment shown, the first phase 124 is predominantly crude oil, and the second phase 126 is predominantly water. Corrosion is most likely to occur in water phase 126. The pace of corrosion can be high due to conditions inside vessel 122. For example, the first phase 124 or second phase 126 can have low resistivity, high temperature, high total dissolved solids, and a high percentage of $H_2S$. Temperatures can be, for example, in excess of 50 degrees C.

Anode assembly 128 is an ICCP anode assembly for providing corrosion protection to vessel 122. One or more anode assemblies 128 are spaced apart around the interior surfaces of vessel 122. A large storage vessel, for example, can have 50 anode assemblies 128, although more or fewer anode assemblies 128 can be used. At least a portion of the anode assemblies 128 are positioned to be in contact with the second phase 126. Anode assembly 128 includes anode 130 mounted on anode mount 132. Encapsulant 134 encapsulates all or a portion of anode 130. Anode assembly 128 is positioned through orifice 136 of vessel 122. Flange 138 is a flange on an outer surface of vessel 122, surrounding orifice 136. Anode mount 132 is mechanically connected to flange 138 of vessel 122. Anode 130 is electrically isolated from vessel 122, by, for example, using a non-conductive mount 132 or having an insulator such as insulated spacer 139 positioned between mount 132 and vessel 122.

Power supply 140 is a direct current ("DC") power supply having a negative line 142 electrically connected to vessel 122 and a positive line 144 electrically connected to anode 130. Power supply 140 can be connected to an alternating current ("AC") power source, and can include a rectifier for converting the AC electricity into DC electricity. When electric current is applied by power supply 140, electric current flows from vessel 122 to anode 130. Ions 146 flow from anode 130 to vessel 122. The anode provides corrosion protection to vessel 122.

Figure 3:
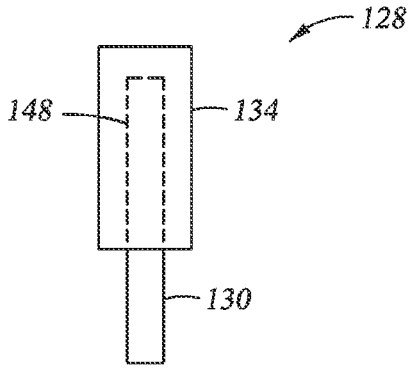
FIG. 3 is an enlarged view of the anode assembly of FIG. 2.

Referring now to FIG. 3, in embodiments, anode 130 is made of a dimensionally stable material such that the material is not consumed or has minimal consumption during operation. Indeed, the dimension of the exterior surface 148 of anode 130 does not change in response to corrosion. Anode 130 is made of a material that does not dimensionally change in response to corrosion, such as mixed metal oxide ("MMO"), platinized niobium ("PtNb"), or platinized titanium ("PtTi").

An encapsulant 134 is used to encapsulate, or coat, anode 130. Encapsulant 134 can be applied to anode 130 in a generally liquid state. After curing to a hardened, cured state, encapsulant 134 is generally rigid. Alternatively, encapsulant 134 can be applied as a powder before being fired and cured. After being applied and when in the cured state, encapsulant 134 covers and is in contact with all or at least a portion of exterior surface 148. In embodiments, encapsulant 134 can be used with ICCP systems. In embodiments, encapsulant 134 is applied to anode 130 before anode 130 is connected to vessel 122. In embodiments, encapsulant 134 is spaced apart from vessel 122, meaning that it is not connected directly to and is not a part of the structure being protected, such as vessel 122, except by way of anode 130.

Encapsulant 134 is a hydrophilic cementitous coating material that permits anode 130 to discharge a current through encapsulant 134. In embodiments, encapsulant 134 is a cementitious material that is permeable, has high mechanical strength, and has the ability to repel waxy materials. Encapsulant 134 can also protect anode 130 from erosion corrosion. In embodiments, grains of encapsulant 134 can be in the general form of spheres with a diameter in a range of 350 μm to 1,500 μm and can have, for example, a diameter of about 950 μm. The grains can have a resin coating. In embodiments, the grains can include crystalline compounds such as mullite and corundum. For example, more than 50% of the crystalline compounds can be mullite or corundum, or a combination of mullite and corundum. Lesser amounts of quartz, bayrite, and microline can also be included in the cement. The composition of an example material is shown in Table 1.

| Compounds | Sample 1 |
|---|---|
| Mullite-$Al_{4.75}Si_{1.25}O_{9.63}$ | 55 |
| Corundum-$Al_2O_3$ | 39 |
| Quartz-$SiO_2$ | 4 |
| Bayrite-$Al_2O_3$ $3H_2O$ | 2 |

-continued

| Compounds | Sample 1 |
|---|---|
| Microcline-$KAlSi_3O_8$ | Trace |
| Hematite-$Fe_2O_3$ | — |
| Albite-$NaAlSi_3O_8$ | — |

In other embodiments, encapsulant 134 can comprise 40% to 60% cement and 40% to 60% carbon, and for example, can comprise 50% cement and 50% carbon and can be, for example, the SAE Inc. product known as Conducrete™.

In embodiments, encapsulant 134 can be electrically conductive. In embodiments, encapsulant 134 can be sufficiently porous to permit ions or electrons to pass therethrough. For example, the encapsulant 134 can have pores with a diameter in a range of 100 μm to 650 μm and can have, for example a diameter of about 200 μmm to 250 μm. Ions 146, thus, can pass from anode 130, through encapsulant 134 and second phase fluid 126 to vessel 122.

In embodiments, encapsulant 134 repels oil droplets and, thus, prevents the oil droplets from collecting on encapsulant 134 and anode 130. Encapsulant 134 is a wax repellent material, meaning that it repels wax, such as paraffin wax, and resists wax deposition. Wax that is present in first phase 124 and second phase 126 does not adhere to encapsulant 134. Furthermore, wax is not able to pass through the pores of encapsulant 134 so encapsulant 134 prevents wax from adhering to and building up on anode 130. In embodiments, encapsulant 134 is acid resistant. More specifically, in embodiments, encapsulant 134 is resistant to $H_2S$. In embodiments, anode 130 is used in a conductive media, such as water, so it is not necessary for encapsulant 134 to have properties that cause it to decrease the contact resistance between anode 130 and the conductive media. In contrast, conventional anodes used in, for example, concrete may need to overcome the high resistivity of that concrete by decreasing the contact resistance in the immediate vicinity of the anode by way of encapsulating the anode in a conductive media.

In embodiments, anode 130 is dimensionally stable so that it does not change shape during operation for at least a predetermined amount of time. Therefore, the outer surface of anode 130 remains in contact with the inner surface of encapsulant 134 for at least the predetermined amount of time. If anode 130 was not dimensionally stable, it could corrode during operation resulting in gaps between the outer surface of anode 130 and the inner surface of encapsulant 134. If such gaps existed, wax could migrate into the gap and have an insulating effect on the anode. By operating for at least the predetermined amount of time without any gaps forming, encapsulant 134 prevents wax from contacting anode 130 for at least the predetermined amount of time. In embodiments, the predetermined amount of time can be between 1 and 20 years. In embodiments, the predetermined amount of time can be between 3 and 15 years. In embodiments, the predetermined amount of time can be between 5 and 10 years. In embodiments, the predetermined amount of time can be greater than 5 years. In embodiments, the predetermined amount of time can be greater than 7 years. In embodiments, the predetermined amount of time can be greater than 10 years.

Figure 4:
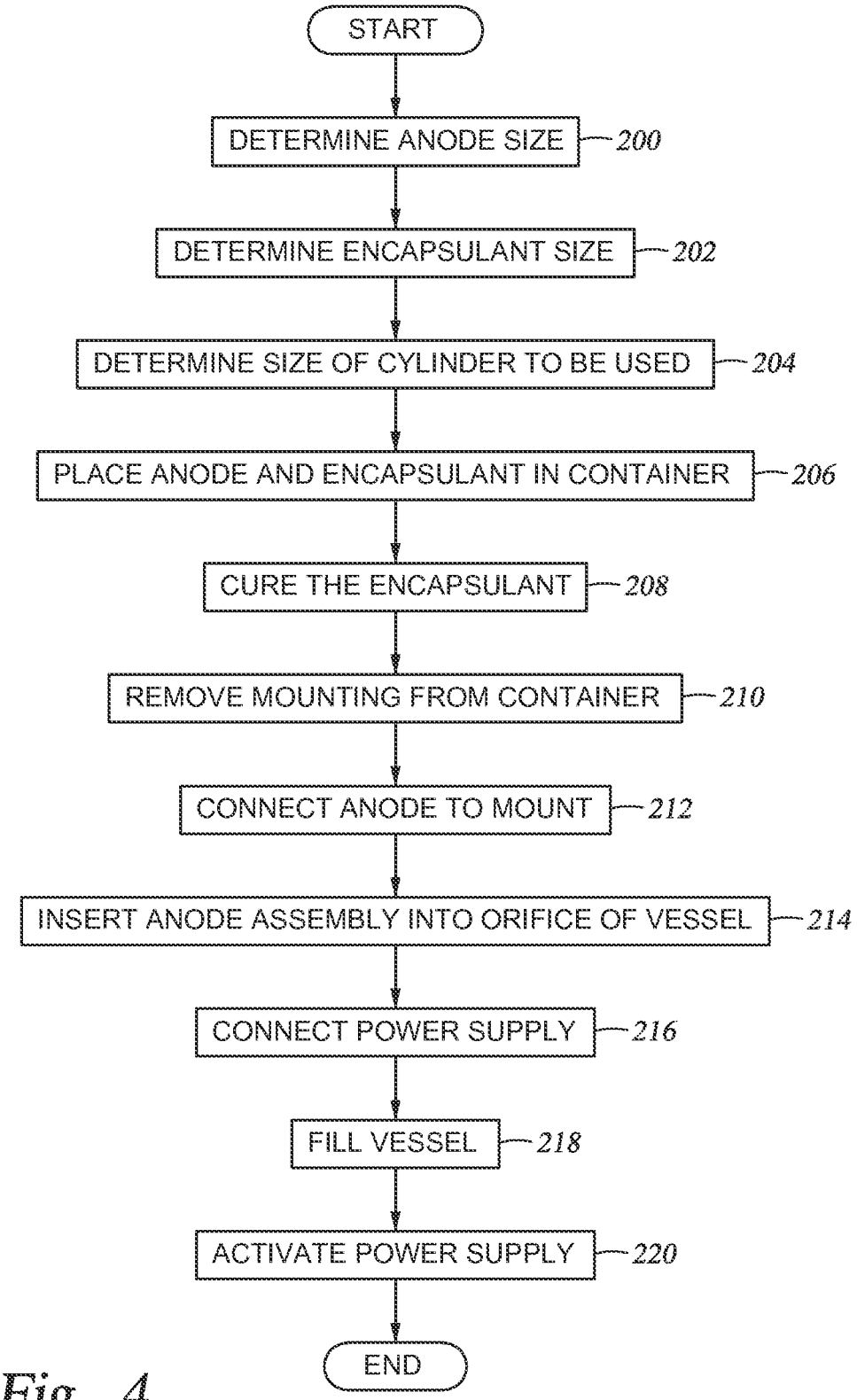
FIG. 4 is flow chart depicting steps for a method of preparing an anode assembly.

Referring now to FIG. 4, an embodiment of a method of preparing an anode assembly 128 is shown. In step 200, select an anode size to provide a predetermined amount of cathodic protection at a given voltage, based on the fluids and conditions expected in the vessel, the size of the vessel, and the number of anodes to be used. In step 202, select the size of the encapsulant 134 to be used. The size of the encapsulant is based on the desired thickness of the encapsulant, the size of the orifice through which the anode assembly is to be inserted, and the size of the vessel. In step 204, determine the size of the container to be used. The container is a mold into which the anode and encapsulant material are to be placed. The size of the container should accommodate the anode 130 and have clearance around it to accommodate the encapsulant, the clearance being equal to or greater than the minimum thickness of the encapsulant.

In step 206, insert the anode 130 and fill the container with the wax-repellent material. This could be done by, for example, placing a nozzle of a cement gun into the container, almost to the bottom of the container, and then slowly squeezing the trigger while the anode is inside. Then filling the container with wax-repellent material by applying steady pressure to the trigger of the cement gun. The container is considered to be filled when the wax-repellent material is flush with an opening of the container.

In step 208, the encapsulant is cured. In embodiments, the encapsulant adheres to the anode as it cures. The curing time is sufficient to cure the encapsulant to a solid state. The curing time can be any amount of time sufficient to cure the encapsulant. In embodiments, the curing time can be, for example, from 1 to 48 hours. In embodiments, the curing time can be 5 to 15 hours. In embodiments, the curing time can be about 12 hours. To cure the encapsulant, the contents of the container are pressurized. This can be accomplished by, for example, placing the entire container in a pressure chamber, or by sealing the container and applying pressure to the interior of the chamber. In embodiments, the contents of the container can be pressurized to about 2500-3500 psi. In embodiments, the contents of the container can be pressurized to about 2900-3100 psi. In embodiments, the contents of the container are pressurized to about 3000 psi. The container can also be heated during the curing time. The temperature can be heated to, for example, between about 50 and 300 degrees C. In embodiments, the temperature can be heated to, for example, between about 100 and 200 degrees C. In embodiments, the temperature can be heated to, for example, between about 140 and 160 degrees C. In embodiments, the temperature can be heated to, for example, about 150 degrees C. In embodiments, the temperature and pressure can be maintained at a constant level, or can be varied in a controlled manner during the curing process. In step 210, the anode and encapsulant assembly is removed from the container. The anode and encapsulant, together, define a mounting and have a high quality, uniform size and shape.

In step 212, the mounting (encapsulant 134 and anode 130) is connected to mount 132 to define anode assembly 128. In step 214, anode 130 and encapsulant 134 are inserted through orifice 136 into vessel 122, and mount 132 is connected to flange 138. In step 216, power supply 140 is connected to anode 130 by way of positive line 142 and negative line 144. In step 218, a fluid is introduced into vessel 122, the fluid contacting encapsulant 134. In step 220, corrosion protection is provided by activating power supply 140 to create a circuit that includes power supply 140, negative line 144, anode 130, either or both of first phase 124 and second phase 126, vessel 122, and positive line 142. First phase 124 and second phase 126 can be initially mixed when introduced into vessel 122, and then separate to form distinct layers. A plurality of anode assemblies can be spaced apart around the interior surfaces of vessel 122, with a portion of the anode assemblies being in contact with first phase 124 and a portion of the anode assemblies being in contact with second phase 126.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within the said range.

Throughout this application, where patents or publications are referenced, the disclosures of these references in their entireties are intended to be incorporated by reference into this application, in order to more fully describe the state of the art to which the invention pertains, except when these reference contradict the statements made herein.

What is claimed is:

1. A cathodic protection system, the cathodic protection system comprising:

a vessel for containing a fluid;

an anode positioned inside the vessel;

an encapsulant encapsulating the anode, wherein the encapsulant comprises a wax repellant cementitious material that is sufficiently porous to allow ions to pass therethrough, wherein the encapsulant comprises grains having a resin coating, the grains comprising a plurality of crystalline compounds including mullite and corundum; and an impressed current source electrically connected to the anode and the vessel, the vessel being a cathode when current is applied from the current source.

2. The system according to claim 1, wherein the encapsulant is spaced apart from the vessel.

3. The system according to claim 1, wherein the encapsulant is hydrophilic.

4. The system according to claim 1, wherein the encapsulant is fluid permeable.

5. The system according to claim 1, wherein a dimension of an exterior surface of the anode does not change in response to corrosion.

6. The system according to claim 1, wherein the anode comprises a material selected of a group consisting of mixed metal oxide ("MMO"), platinized niobium ("PtNb") and platinized titanium ("PtTi").

7. The system according to claim 1, wherein the encapsulant is acid resistant.

8. The system according to claim 1, wherein the encapsulant is resistant to $H_2S$.

9. The system according to claim 1, wherein the vessel comprises a wet crude handling vessel, wherein the anode is positioned inside the wet crude handling vessel.

10. The system according to claim 1, wherein the encapsulant comprises cement and carbon.

11. The system according to claim 1, wherein the encapsulant comprises pores, the pores having a diameter in the range of 100 μm to 650 μm.

12. An anode system, the anode system comprising:

a vessel having an interior surface;

a first phase fluid and a second phase fluid contained within the vessel;

a plurality of anodes spaced apart from each other, each of the plurality of anodes being connected to the interior surface of the vessel and at least a portion of the anodes being positioned within the second phase fluid;

an impressed current source electrically connected to the anode; and an encapsulant encapsulating at least one of the plurality of anodes, the encapsulant comprising a wax repellant cementitious material operable to transmit ions therethrough, wherein the encapsulant comprises grains having a resin coating, the grains comprising a plurality of crystalline compounds including mullite and corundum.

13. The system according to claim 12, wherein the first phase comprises crude oil and the second phase comprises water.

14. The system according to claim 12, further comprising an absence of direct contact between the encapsulant and the vessel.

15. The system according to claim 12, wherein the encapsulant is hydrophilic.

16. The system according to claim 12, wherein a dimension of an exterior surface of the anode does not change in response to corrosion.

17. The system according to claim 12, wherein the anode comprises a material selected from a group consisting of mixed metal oxide ("MMO"), platinized niobium ("PtNb") and platinized titanium ("PtTi").

18. The system according to claim 12, wherein the vessel comprises a wet crude handling vessel, wherein the anode is positioned inside the wet crude handling vessel.

19. A method of providing corrosion protection to a vessel, the method comprising the steps of:

(a) selecting an anode size to provide a predetermined amount of cathodic protection at a predetermined voltage, based on the fluids and conditions expected in the vessel, the size of the vessel, and the number of anodes to be used;

(b) selecting a minimum thickness for an encapsulant to encapsulate the anode;

(c) determining a minimum size of a container to be used, the minimum size having an internal dimension greater than a dimension of the anode and the thickness of the encapsulant;

(d) inserting the anode into the container and filling the remaining space in the container with the encapsulant, the encapsulant being in a generally liquid, uncured state, wherein the encapsulant comprises grains having a resin coating, the grains comprising a plurality of crystalline compounds including mullite and corundum;

(e) curing the encapsulant to a hardened state and then removing the anode and the encapsulant from the container;

(f) connecting the anode to a mount and then connecting the mount to the vessel so that the anode is positioned inside the vessel; and (g) filling the vessel with fluid and applying a voltage between the vessel and the anode so that ions flow from the anode, through the fluid, to the vessel.

20. The method according to claim 19, wherein step (e) further comprises pressurizing the encapsulant while it cures.

21. The method according to claim 19, wherein step (e) further comprises heating the encapsulant while it cures.

* * * * *